US008509385B2

(12) United States Patent
Tang et al.

(10) Patent No.: US 8,509,385 B2
(45) Date of Patent: Aug. 13, 2013

(54) X-RAY TUBE WITH IMPROVED VACUUM PROCESSING

(75) Inventors: Liang Tang, Waukesha, WI (US); Eric Bruce Biehr, Milwaukee, WI (US); Richard Michael Roffers, Menomonee Falls, WI (US); Kalyan Koppisetty, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 298 days.

(21) Appl. No.: 12/898,305

(22) Filed: Oct. 5, 2010

(65) Prior Publication Data

US 2012/0082299 A1 Apr. 5, 2012

(51) Int. Cl.
*H01J 35/20* (2006.01)

(52) U.S. Cl.
USPC ..... 378/123; 378/136

(58) Field of Classification Search
USPC ..... 378/123, 136
See application file for complete search history.

(56) References Cited

U.S. PATENT DOCUMENTS

| | | | | |
|---|---|---|---|---|
| 3,846,006 | A | 11/1974 | Atlee et al. | |
| 4,305,631 | A | 12/1981 | Iversen | |
| 5,733,162 | A | 3/1998 | Benz et al. | |
| 6,212,256 | B1 | 4/2001 | Miesbauer et al. | |
| 6,453,009 | B2 | 9/2002 | Berezowitz et al. | |
| 6,961,407 | B2 | 11/2005 | Deuringer et al. | |
| 2004/0240617 | A1 * | 12/2004 | Deuringer et al. | 378/136 |
| 2010/0142680 | A1 * | 6/2010 | August | 378/138 |

* cited by examiner

*Primary Examiner* — Hoon Song
(74) *Attorney, Agent, or Firm* — Fletcher Yoder, P.C.

(57) ABSTRACT

In one embodiment, an X-ray tube includes an electron beam source including a primary cathode configured to emit an electron beam and an anode assembly including an anode configured to receive the electron beam and to emit X-rays when impacted by the electron beam. The X-ray tube also includes an enclosure, at least the primary cathode and the anode being disposed in the enclosure, and a secondary cathode disposed in the enclosure and configured to emit electrons to impact the anode for degassing the enclosure.

23 Claims, 5 Drawing Sheets

X-RAY TUBE WITH IMPROVED VACUUM PROCESSING

BACKGROUND OF THE INVENTION

The subject matter disclosed herein relates to X-ray tube radiation sources and more particularly to the processing of X-ray tubes.

In non-invasive imaging systems, X-ray tubes are used in projection X-rays systems, fluoroscopy systems, tomosynthesis systems, and computer tomography (CT) systems as a source of X-ray radiation. Typically, the X-ray tube includes a cathode and an anode. An emitter within the cathode emits a stream of electrons in response to heat resulting from an applied electrical current via the thermionic effect. The anode includes a target that is impacted by the stream of electrons. The target, as a result, produces X-ray radiation and heat. Such systems are useful in medical contexts, but also for parcel and package screening, part inspection, various research contexts, and so forth.

The radiation traverses a subject of interest, such as a human patient, and a portion of the radiation impacts a detector or photographic plate where the image data is collected. In some X-ray systems, the photographic plate is then developed to produce an image which may be used by a radiologist or attending physician for diagnostic purposes. In digital X-ray systems, a photo detector produces signals representative of the amount or intensity of radiation impacting discrete pixel regions of a detector surface. The signals may then be processed to generate an image that may be displayed for review. In CT and tomosynthesis systems, a detector array, including a series of detector elements, produces similar signals through various positions as a gantry is displaced around a patient, and processing techniques are used to reconstruct a useful image of the subject.

The X-ray tube may have a useful life over a large number of examination sequences, and must generally be available for examination sequences upon demand in a medical care or other facility. Given the demanding schedules to which X-ray tubes are often subjected, failure of the tubes is of particular concern. Various failure modes have been observed in X-ray tubes, and these have a variety of sources. For example, during processing of the X-ray tube moisture, hydrocarbons, or other particulates may remain within the X-ray tube even after bakeout heating and processing under vacuum. Further sources of X-ray tube failure occur during post-processing use due to leaks, degradation in the cathode or anode materials, and so forth, where particulates may be created or freed within the tube. These particulates may result in eventual failure of the tubes over time.

BRIEF DESCRIPTION OF THE INVENTION

In accordance with one embodiment, an X-ray tube includes an electron beam source including a primary cathode configured to emit an electron beam and an anode assembly including an anode configured to receive the electron beam and to emit X-rays when impacted by the electron beam. The X-ray tube also includes an enclosure, at least the primary cathode and the anode being disposed in the enclosure, and a secondary cathode disposed in the enclosure and configured to emit electrons to impact the anode for degassing the anode and the enclosure during processing.

In accordance with another embodiment, a method for making an X-ray tube includes assembling the X-ray tube including an electron beam source comprising a primary cathode configured to emit an electron beam during normal operation of the X-ray tube, an anode assembly including an anode configured to receive the electron beam and to emit X-rays when impacted by the electron beam, an enclosure, at least the primary cathode and the anode being disposed in the enclosure, and a secondary cathode disposed in the enclosure adjacent to the anode. The method also includes energizing the anode and the secondary cathode to emit electrons from the secondary cathode to degas the interior volume, and sealing the interior volume.

In accordance with a further embodiment, an X-ray tube includes an electron beam source including a primary cathode configured to emit an electron beam and an anode assembly including an anode configured to receive the electron beam and to emit X-rays when impacted by the electron beam. The X-ray tube also includes an enclosure, at least the primary cathode and the anode being disposed in the enclosure, and an ion gauge assembly including a secondary cathode, the ion gauge assembly configured to detect materials within the enclosure during use of the X-ray tube.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present approaches are directed to the integration of a secondary cathode within X-ray tubes. The secondary cathode may be employed in processing the X-ray tube. More specifically, during X-ray tube processing the secondary cathode employed in the present approaches may be heated by an electrical current resulting in the emission of electrons from the secondary cathode towards an anode and degassing of the X-ray tube. The use of the secondary cathode for degassing spares the use of the X-ray tube primary cathode during processing and may extend the life of the primary cathode. In addition, the secondary cathode may be used to detect vacuum integrity within the X-ray tube during processing and post-processing and to act as a diagnostic tool for potential X-ray tube errors and failures related to high pressure.

According to the present approaches, the secondary cathode may eliminate the need for the standard bakeout technique used to process X-ray tubes, and/or shorten the processing time for evacuation of tubes during manufacture. In one embodiment, the secondary cathode may consist of a filament that is heated to emit electrons via the thermionic effect at the anode to heat the anode and to degas or to contribute to degassing the X-ray tube. In some embodiments, the secondary cathode may be positively or negatively biased. For example, a negatively biased secondary cathode may include a cup to direct or focus the electrons from the filament towards the anode. In another embodiment, the secondary cathode may form a portion of an ion gauge for use during and/or subsequent to processing of X-ray tubes. For example, the ion gauge may monitor the presence of residual gasses or leaks within the X-ray tube and provide a signal representative of the vacuum state within the X-ray tube.

Figure 1:
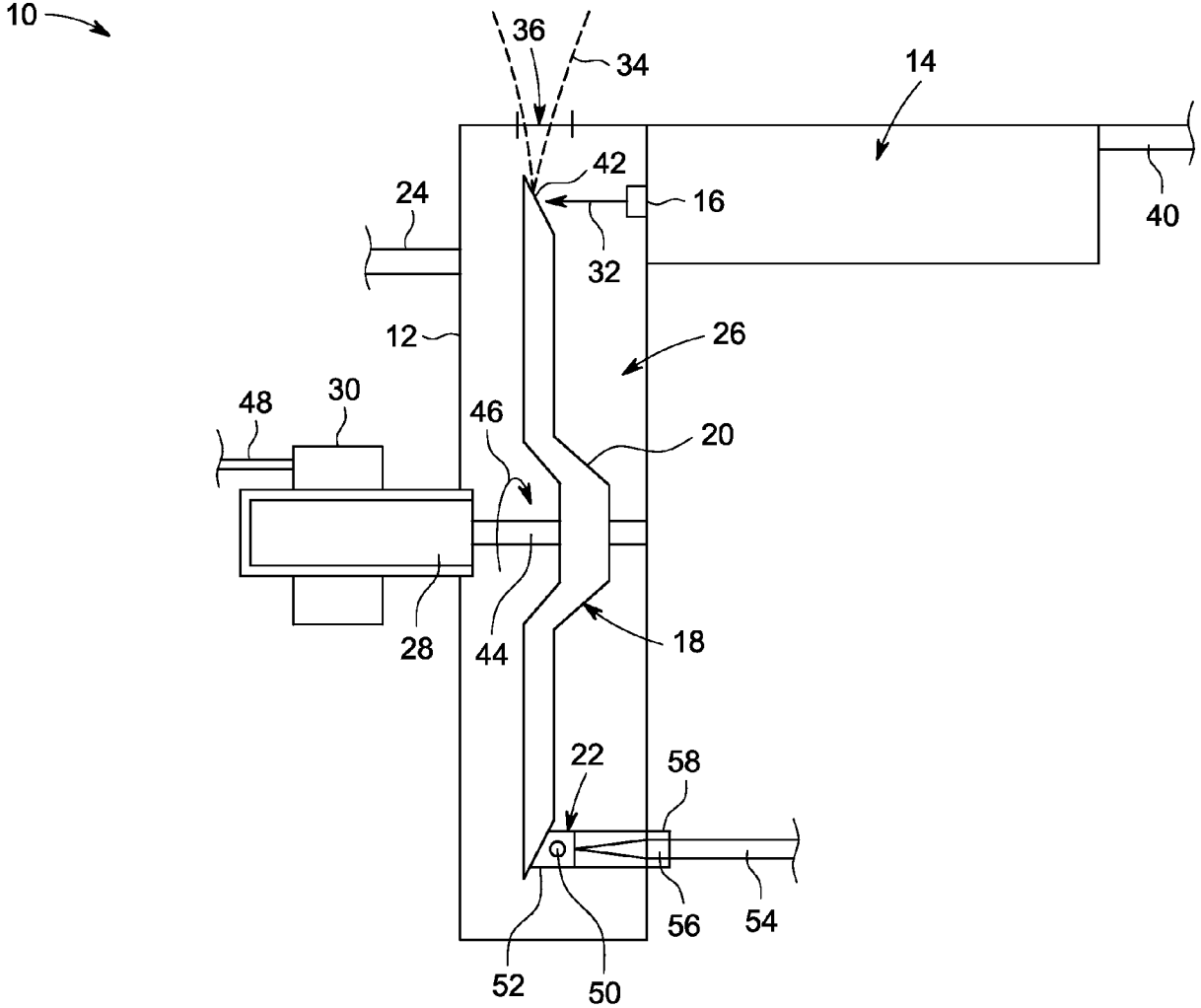
FIG. 1 is a diagrammatical view of an exemplary X-ray tube in accordance with aspects of the present disclosure.

With this in mind, and turning now to the figures, FIG. 1 is a diagram that illustrates an X-ray tube 10 in accordance with aspects of the present disclosure. The X-ray tube 10 includes an enclosure 12, an electron beam source 14 including a primary cathode 16, a secondary cathode 22, and an anode assembly 18 including an anode 20. The enclosure 12 may be a glass or metallic envelope. The X-ray tube 10 may be positioned within a casing (not shown) which may be made of aluminum and lined with lead. During processing, the X-ray tube 10 is connected to an exhausting tubulation 24 configured to generate a vacuum within the X-ray tube 10. The exhausting tubulation 24 is connected to an interior volume 26 of the enclosure 12. Indeed, the enclosure 12 at least partially surrounds and encloses a controlled volume 26. The controlled volume 26 includes a rotor 28 of a motor that rotates the anode 20 and at least a portion of the electron beam source 14 (e.g., the primary cathode 16). As illustrated, the primary cathode 16, the anode 20, and the secondary cathode 22 are disposed within the enclosure 12, while a stator 30 is disposed outside the enclosure 12 adjacent the rotor 28.

The primary cathode 16 is configured to emit an electron beam, as indicated by arrow 32. The anode 20 is configured to receive the electron beam 32 and to emit X-rays, as indicated by dashed lines 34, when impacted by the electron beam 32. A window 36 is disposed adjacent where the electron beam 32 impacts the anode 20. As illustrated, the window 36 is disposed at one side of the X-ray tube 10. The window 36 is configured to allow the emitted X-rays 34 to exit the enclosure 12. More specifically during operation of the X-ray tube 10, the electron beam source 14 is coupled to a high voltage source 40 that allows heating of a filament (not shown) of the primary cathode 16 via an applied electrical current to generate a hot filament that releases electrons 32 at a high velocity under high voltage. In a vacuum, due to the thermionic effect, the emitted electrons 32 accelerate and impact a target 42 of a rotating anode 20 resulting in the emission of X-rays 34. The voltage difference between the primary cathode 16 and the anode 20 may range from tens of thousands of volts to in excess of hundreds of thousands of volts. The anode 20 is coupled to the rotor 28 via a shaft 44. Rotation of the anode 20, as indicated by arrow 46 is driven by the rotor 28 disposed within stator 30 and powered by a power source 48 coupled to the stator 30. The rotation of the anode 20 allows the electron beam 32 to constantly strike a different point on the anode perimeter. Depending upon the construction of the X-ray tube 10, the desired radiation may be emitted by substances such as radium and artificial radiotropics, as well as electrons, neutrons, and other high speed particles. Within the enclosure 12 of the X-ray tube 10, a vacuum of the order of $10^{-5}$ to about $10^{-9}$ torr at room temperature is preferably maintained to permit unperturbed transmission of the electron beam 32 between the primary cathode 16 and the anode 20.

During X-ray tube processing, the exhausting tubulation 24 will typically be connected to a vacuum pump. During bake-out process, the X-ray tube 10 is placed in a heated oven. The bakeout processing of the X-ray tube 10 includes applying heat to the tube 10 via the oven, while degassing (evacuating gases from) the tube 10 via a vacuum pump. Following bakeout, but while continuing degassing, seasoning or energization occurs. Energization of the primary cathode 16 occurs by heating the cathode 16 to generate the electron beam 32. Energization of the anode 20 occurs by driving the anode 20 in rotation within the enclosure 12. The electron beam 32 impacts the anode 20 allowing conditioning of the focal track and verification of the spot size of the electron beam 32. Seasoning also results in additional degassing by heating the other components of the X-ray tube 10. Following bakeout and seasoning, the interior volume 26 is sealed by crimping of the tubing 24. In conventional processing, this degassing procedure may require many hours and reduces the amount of residual gases present in the X-ray tube 10 that can result in events such as "spitting/vacuum breakdown." Spitting refers to an unwanted discharge caused by a particle or high pressure present in the interior volume 26 and within the path of the electron beam 32 that diverts the electrons 32 to some other point besides the focal track of the target 42 of the anode 20.

As mentioned above, the X-ray tube 10 includes the secondary cathode 22. The secondary cathode 22 is used in processing of the X-ray tube, in the presence or absence of the heat generated by the bakeout process. In the illustrated embodiment the secondary cathode 22 includes a filament structure 50 and cup 52, although other arrangements may be employed. The filament structure 50 is configured to be heated in use. The filament structure 50 may include one or more filaments. The shape of the filament structure 50 may be a helical coil, a D-shape, a flat emitter, or any other desired shape. The filament structure 50 may be made of tungsten or any other suitable material. The cup 52 is configured to direct electron emissions from the filament structure 50 towards the anode 20. The cup 52 may act as an electrostatic lens that focuses the electrons emitted from the filament structure 50 supported by the cup 52. The cup 52 may be made of stainless steel, cobalt, molybdenum, or any other suitable material. The cup 52 is connected to a power source via a cable 54 coupled to a HV insulator 56 (e.g., a 50 kV insulator) partially encapsulated by a sealed body 58 located at the enclosure 12. The filament structure 50 is heated via an applied current to release electrons at a high velocity via the thermionic effect. The cup 52 focuses these electrons at the anode 20.

The secondary cathode 22 is disposed within the enclosure 12 and configured to emit electrons to impact the anode 20 for degassing the enclosure 12. For example, in the specific embodiment illustrated, the secondary cathode 22 is disposed 180 degrees away from the primary cathode 16 circumferentially around the anode 20. The secondary cathode 22 can be disposed circumferentially anywhere around the anode 20. Further, as illustrated, the secondary cathode 22 is negatively biased with respect to the anode 20. In other words, the anode 20 is grounded and the secondary cathode 22 is negatively biased.

Similar to the X-ray tube processing described above, processing using the secondary cathode 22 involves connecting the exhausting tubulation 24 to a vacuum pump. As a vacuum is drawn, the secondary cathode 22 is energized. Energization of the secondary cathode 22 involves heating the filament structure 50 of the cathode 22 to emit electrons towards the anode 20. The emission of the electrons from the secondary cathode 22 towards the anode 20 degasses the anode 20 and other components of the enclosure 12. The primary cathode 16 is then energized, and followed by the sealing of the interior volume 26, as described above. The use of the secondary cathode 22 during processing may result in less local pressure excursion present in the interior volume 26 during the energization of the primary cathode 16. Hence, the energization of the primary cathode 16 may occur at a lower power level relative to processing in the absence of the use of the secondary cathode 22. This may result in the extension of the filament life of the primary cathode 16. Further, processing involving the secondary cathode 22 heats components more quickly than in a standard bakeout process and may reduce processing time of X-ray tubes 10 considerably. In certain embodiments, the bakeout processing may also occur prior to and/or during the energization of the secondary cathode 22. In some embodiments, the secondary cathode 22 may or may not be energized to assist in degassing or in the bakeout processing. In these embodiments, the secondary cathode 22 may be used for another function as described in greater detail below.

Figure 2:
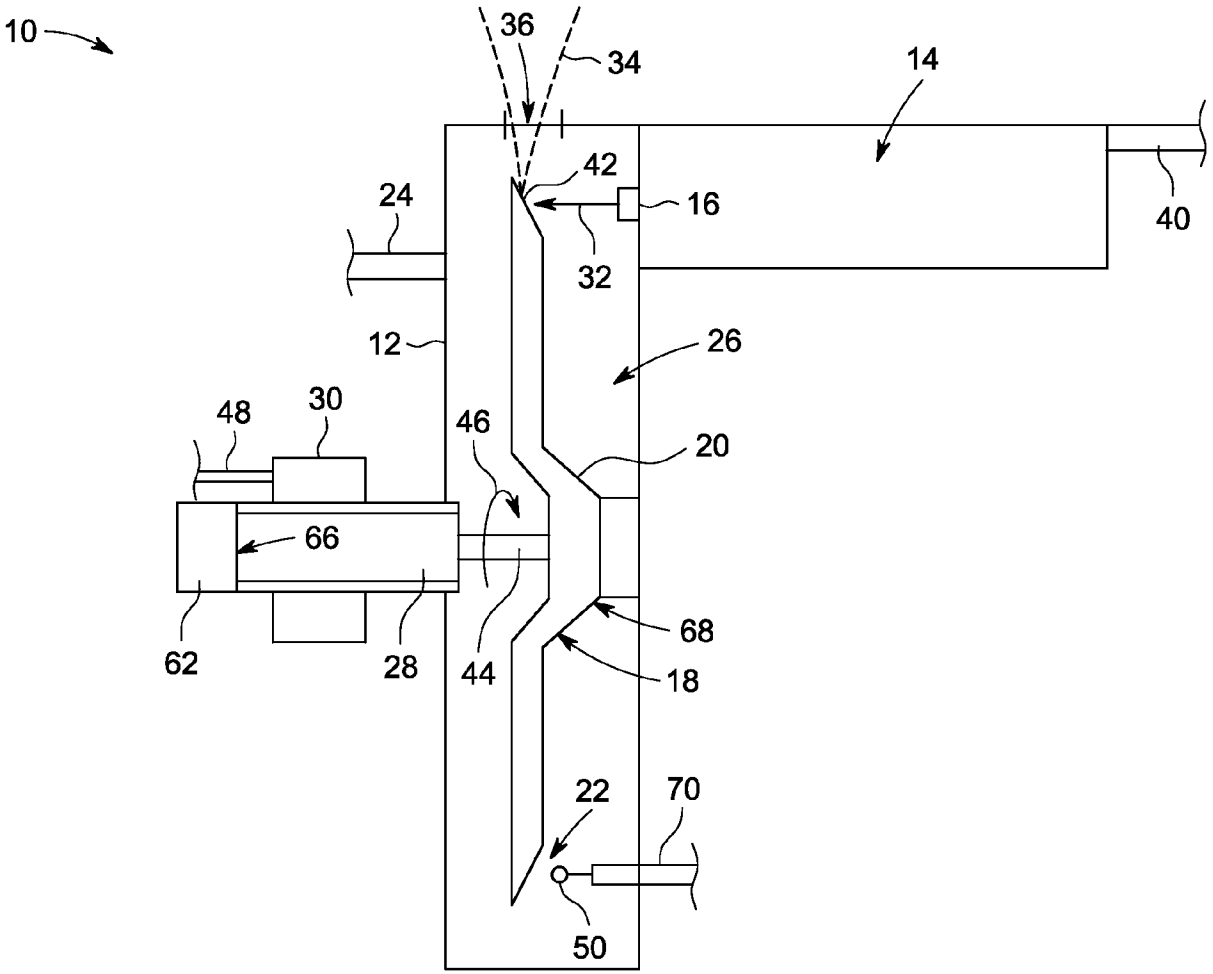
FIG. 2 is a further diagrammatical view of an exemplary X-ray tube in accordance with aspects of the present disclosure.

Depending on the bias of the secondary cathode 22, the X-ray tube 10 may be configured differently. FIG. 2 is a diagram that illustrates an alternative embodiment of X-ray tube 10 in accordance with aspects of the present disclosure. The X-ray tube 10 includes the enclosure 12, the electron beam source 14, and the anode assembly 18 as described above. However, the secondary cathode 22 and the casing (not shown) are positively biased. Thus, the anode 20 is designed to be electrically isolated (e.g., from 25 kV up to 50 kV). To electrically isolate the X-ray tube 10, anode insulator 62 is located on a back side 66 of the rotor 28 of the anode 20, respectively, within the enclosure 12. The secondary cathode 22 includes filament structure 50 coupled to a cable 70 for a low voltage feed-thru. The filament structure 50 may be as described above. The secondary cathode 22 is disposed within the enclosure 12 and configured to emit electrons to impact the anode 20 for degassing the anode 20 and other components in the enclosure 12. The secondary cathode 22 can be disposed circumferentially anywhere around the anode 20. Operation of the secondary cathode 22 in degassing occurs by heating the filament structure 50 via an applied current to release electrons at a high velocity via the thermionic effect. The positive bias on the anode 20, while the filament structure 50 and the casing are at ground potential, directs the electrons to the anode 20. When the anode 20 is positively biased, the secondary cathode 22 may be used for X-ray tube processing as described above. In certain embodiments, the secondary cathode 22 may include a bulk getter body. The bulk getter body may include a sheet, a wire, or sintered powder of gas-absorbing metal such as strontium, barium, zirconium, or other metal.

Preferably generation of the electron beam 32 from the primary cathode 16 occurs in a vacuum. However, during processing, particulates may be present. Also, particulates may be present in the X-ray tube 10 during post-processing operation. Such particulates may be introduced in the tube 10 by leaks, degradation of system components within the tube 10, decomposition of the tube filaments, and so forth. These particulates may increase the pressure within the X-ray tube 10 during processing and post-processing. Operation of the primary cathode 16 at higher pressure may result in filament degradation and the shortening of the life of the filament. When electron beam 32 impacts such particulate matter, the electron beam may continue toward the anode 20. In certain cases, however, the electron beam may be deflected from the target 42 on the anode 20. Both incidents create high current discharges. When particulate is encountered by the electron beam 32 and the beam continues along its path to impact the anode 20, an anode overcurrent event may occur. Moreover, as noted above, where the electron beam 32 is diverted from the anode by the particulate, the high current discharge event is generally termed a "spit" in the art.

Figure 3:
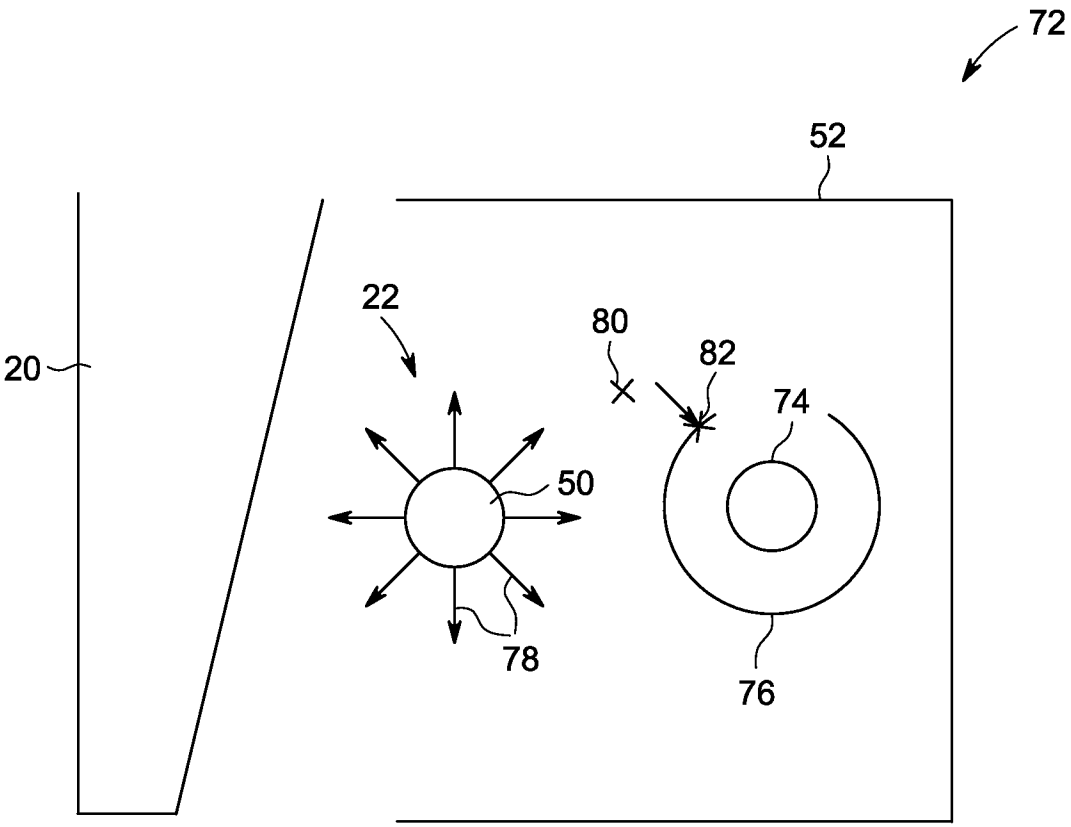
FIG. 3 is a diagrammatical view of an exemplary ion gauge of an X-ray tube in accordance with aspects of the present disclosure.

As mentioned above, the secondary cathode 22 may be used for other functions. FIG. 3 illustrates an ion gauge assembly 72 of an X-ray tube 10 in accordance with aspects of the present disclosure. The ion gauge assembly 72 is located adjacent the anode 20 of the X-ray tube 10. The ion gauge assembly 72 is configured to measure pressure, within the enclosure 12 during use of the X-ray tube 10. Further, the ion gauge assembly 72 may also be configured to detect pressure during the processing of the X-ray tube 10. The ion gauge assembly 72 includes the secondary cathode 22 that includes the filament structure 50 described above. The ion gauge assembly 72 also includes a grid 76 and a collector 74. The ion gauge assembly 72 may also include the cup 52 as described above. An ion gauge controller (not shown) may maintain the voltage of the components of the ion gauge assembly 72. The filament structure 50 is heated by an applied current to emit electrons, as indicated by arrows 78, via the thermionic effect. The emitted electrons 78 are accelerated toward the grid 76 due to the potential difference between the filament structure 50 and the grid 76. However, these emitted electrons 78 may collide with a gas molecule, as indicated by reference numeral 80, dislodging an electron and creating a positively charged ion, as indicated by reference numeral 82. The positively charge ion 82 may then accelerate towards the collector 74. The rate at which electron collisions with molecules occur is proportional to the density of gas molecules. Thus, the ionic current is proportional to the gas density (i.e., pressure). From the ionic current, the vacuum pressure may be determined within the enclosure 12 of the X-ray tube 10. The ion gauge assembly 72 is coupled to a monitoring circuit (not shown). The monitoring circuit is configured to generate a signal representative of a vacuum state within the enclosure 12 of the X-ray tube 10 based upon detection of materials (e.g., the particles described above) within the enclosure 12.

The ion gauge assembly 72 may be used during X-ray tube processing to determine whether the vacuum pressure is low enough for energizing the primary cathode 16 and the anode 20. This may preserve or extend the life of the primary cathode 16 and reduce early life failures of the cathode 16. The ion gauge assembly 72 may also be used post-processing to monitor the vacuum pressure and serve as a diagnostic tool for troubleshooting X-ray tube errors and failures. For example, the ion gauge assembly 72 and the information gathered from the assembly 72 may be incorporated in systems and apparatus for replacement management and life prediction of X-ray tubes 10, as described in greater detail in U.S. Pat. No. 6,212,256, entitled "X-ray Tube Replacement Management System," and U.S. Pat. No. 6,453,009, entitled "X-ray Tube Life Prediction Method and Apparatus," both of which are hereby incorporated by reference in their entirety.

The ion gauge assembly 72 may also be energizable during manufacture of the X-ray tube to degas the interior volume 26 of the enclosure 12. With the grid 76 and the collector 74 off, the secondary cathode 22 may be energized to emit electrons that impact the anode 20 during degassing. The processing of the X-ray tube 10 may occur as described above. After energization of the secondary cathode 22, the grid 76 and the collector 74 may be activated and the ion gauge assembly 72 can monitor the vacuum pressure within the enclosure 12 prior to energization of the primary cathode 16.

Figure 4:
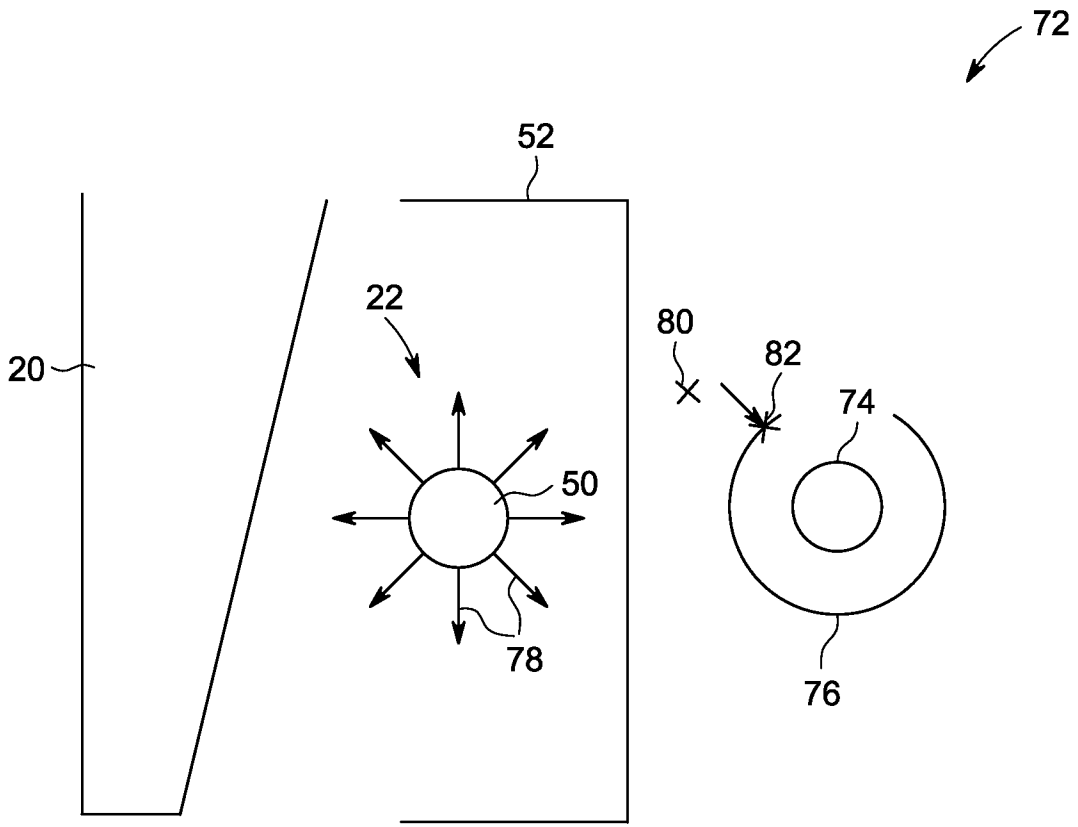
FIG. 4 is a diagrammatical view of an exemplary ion gauge of an X-ray tube in accordance with aspects of the present disclosure.

FIG. 4 illustrates another embodiment of the ion gauge assembly 72 of the X-ray tube 10 in accordance with aspects of the present disclosure. The structure of the ion gauge assembly 72 is similar to the embodiment in FIG. 3, except the cup 52 is located between the secondary cathode 22 and the grid 76 and the collector 74. Thus, the cup 52 separates the secondary cathode 22 from the grid 76 and the collector 74. Electrons 78 coming out of the filament 50 due to thermionic emission will be accelerated towards the cup 52 due to its higher potential. The cup 52 may have holes to provide line of sight for the electrons 78 to reach the collector 74, thus, the cup 52 acts as a grid. In certain embodiments, the grid 76 will be absent from the ion gauge assembly 72. Electrons 78 accelerating towards the cup 52 (i.e., grid) may acquire approximately 200 eV due to the potential difference. The accelerating electrons 78 may collide with residual gas resulting in ions 82. The positively charged ions 82 may accelerate towards the collector 74 and the resultant electrons back to the cup 52 (i.e., grid). Thus, the cup 52 acts as a grid for the ion gauge assembly 72. This may allow the collector 74 and the cup 52 to have the same potential during degassing and, thus, provide better focusing.

Figure 5:
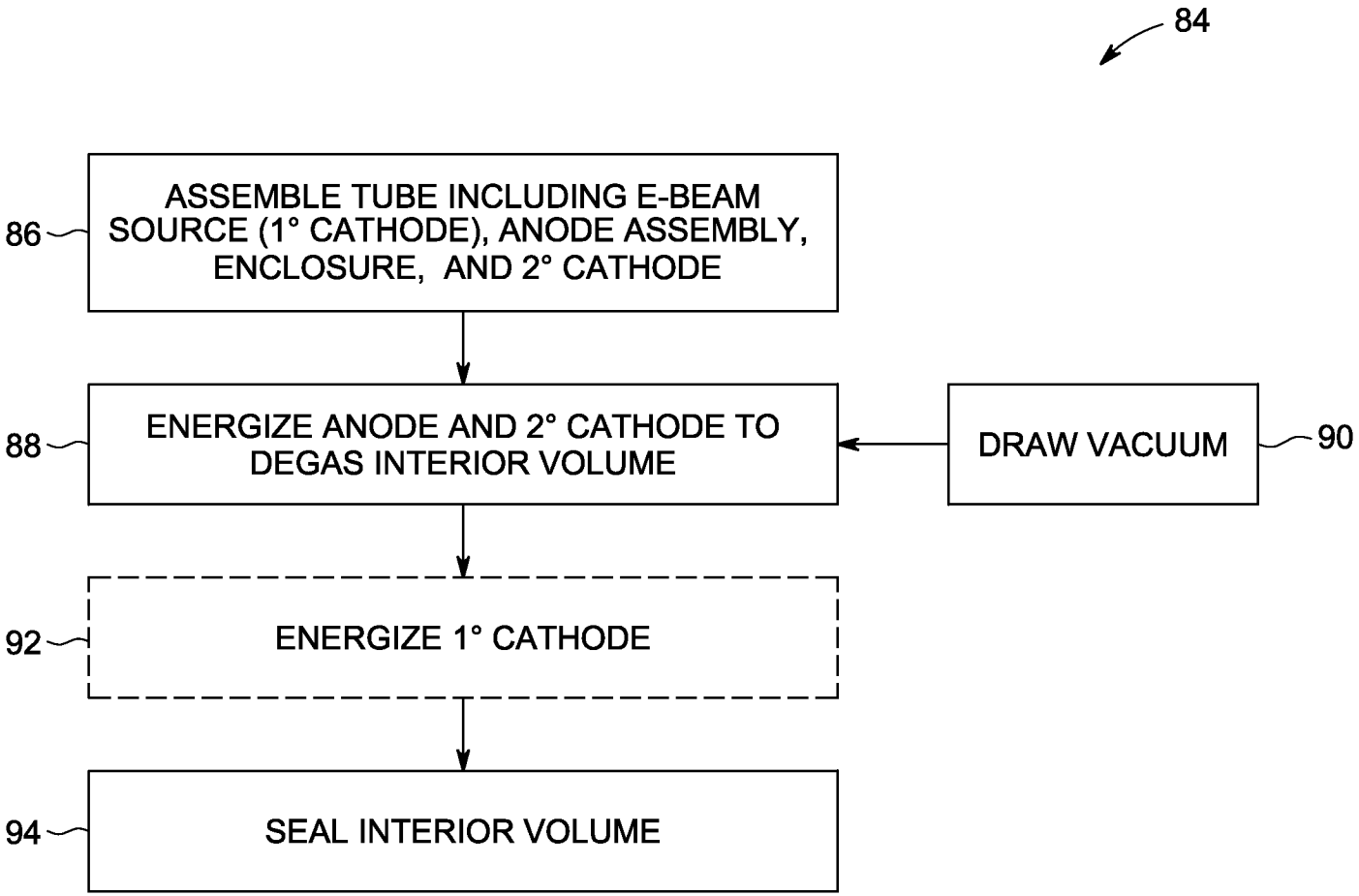
FIG. 5 is a flow diagram of exemplary steps in a method for making an X-ray tube in accordance with aspects of the present disclosure.

FIG. 5 illustrates a flow diagram of exemplary steps in a method 84 for making an X-ray tube 10 in accordance with aspects of the present disclosure. The method 84 includes assembling the X-ray tube 10 (block 86), where the tube 10 includes electron beam source 14 that includes primary cathode 22 configured to emit the electron beam 32 during normal operation of the tube 10. The X-ray tube 10 also includes anode assembly 18 that includes anode 20 configured to receive the electron beam 32 and to emit X-rays when impacted by the electron beam 32. The X-ray tube 10 further includes enclosure 12 with at least the primary cathode 16 and the anode 20 disposed within the enclosure 12, as well as the secondary cathode 22 disposed within the enclosure 12 adjacent the anode 20. In some embodiments, the anode 20 is grounded and the secondary cathode 22 is negatively biased as described above. In other embodiments, the anode 20 is electrically isolated and positively biased, and the secondary cathode 22 is grounded.

The method 84 also includes energizing the anode 20 and the secondary cathode 22 to emit electrons from the secondary cathode 22 to degas the interior volume 26 of the tube assembly (block 88), as described above. For example, energization of the anode 20 may include driving the anode 20 in rotation within the enclosure 12. A vacuum may be drawn on the interior volume of the tube assembly (block 90) during and/or prior to energization of the secondary cathode 22 via the exhausting tubulation 24 as described above. In some embodiments, the tube assembly may be subject to heat prior to and/or during energization of the secondary cathode 22 (e.g., via bakeout in an oven).

Following energization of the secondary cathode 22, the primary cathode 16 may be energized (block 92), as described above, prior to sealing the interior volume 26 of the tube assembly. In certain embodiments, the secondary cathode 22 may not be energized if the primary cathode 16 is energized prior to sealing the interior volume 26. When the secondary cathode 22 is not energized and the primary cathode 16 is energized prior to sealing of the interior volume 26, the secondary cathode 22 may be used as an ion gauge 72 to monitor the vacuum state of the tube assembly subsequent to processing. Further, the method 84 includes sealing the interior volume 26 (block 94). Sealing the interior volume 26 may include crimping or otherwise sealing the exhausting tubulation 24 following degassing. From method 84, X-ray tubes 10 as described in the above embodiments may be made.

The secondary cathode 22 described above allows X-ray tube processing in conjunction with or in lieu of the bakeout process to provide a lower pressure environment for the filament of the primary cathode 16 prior to energization of the cathode 16. This may extend the life of the filament of the primary cathode 16 and reduce early life failures or poisoning of this filament. In addition, use of the secondary cathode 22, during processing may reduce the processing time normally associated with the bakeout process. Further, the secondary cathode may act as an ion gauge to help monitor the presence of materials and, thus, the vacuum state within the enclosure 12 of the X-ray tube 10 during and subsequent to processing, and to act as a tool in diagnostics and quality control.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray tube comprising:

an electron beam source comprising a primary cathode configured to emit an electron beam;

an anode assembly comprising an anode configured to receive the electron beam and to emit X-rays when impacted by the electron beam;

an enclosure, at least the primary cathode and the anode being disposed in the enclosure;

a secondary cathode disposed in the enclosure and configured to emit electrons to impact the anode for degassing the enclosure, wherein the secondary cathode comprises a filament configured to be heated to emit the electrons; and a cup disposed about and supporting the filament, wherein the cup is configured to focus the electrons emitted from the filament at the anode.

2. The X-ray tube of claim 1, wherein the anode is grounded and the secondary cathode is negative biased.

3. The X-ray tube of claim 1, wherein the anode is electrically isolated and positively biased, and the secondary cathode is grounded.

4. The X-ray tube of claim 1, wherein the enclosure encloses a controlled volume, the controlled volume including a rotor of a motor that rotates the anode, and at least a portion of the electron beam source.

5. The X-ray tube of claim 1, wherein the secondary cathode comprises an ion gauge configured to measure pressure within the enclosure during use of the X-ray tube.

6. The X-ray tube of claim 5, comprising a monitoring circuit coupled to the ion gauge and configured to generate a signal representative of vacuum state within the enclosure based upon detection of pressure within the enclosure.

7. The X-ray tube of claim 1, wherein the secondary cathode is disposed at least 90 degrees away from the primary cathode circumferentially around the anode.

8. The X-ray tube of claim 5, wherein the ion gauge comprises a collector configured to collect positively charged ions created by collisions between the emitted electrons and gas molecules within the enclosure.

9. A method for making an X-ray tube, comprising:

assembling the X-ray tube comprising an electron beam source comprising a primary cathode configured to emit an electron beam during normal operation of the X-ray tube, an anode assembly comprising an anode configured to receive the electron beam and to emit X-rays when impacted by the electron beam, an enclosure, at least the primary cathode and the anode being disposed in the enclosure, and a secondary cathode disposed in the enclosure adjacent to the anode;

energizing the anode and the secondary cathode to emit electrons from the secondary cathode to degas the interior volume; and sealing the interior volume.

10. The method of claim 9, wherein the anode is grounded and the secondary cathode is negatively biased.

11. The method of claim 9, wherein the anode is electrically isolated and positively biased, and the secondary cathode is grounded.

12. The method of claim 9, wherein an exhausting tubulation is disposed in fluid communication with an interior volume, and wherein the method comprises drawing a vacuum on the interior volume during energization of the secondary cathode.

13. The method of claim 12, comprising crimping the exhausting tubulation following degassing to seal the interior volume.

14. The method of claim 12, comprising subjecting the tube assembly to heat during energization of the secondary cathode.

15. The method of claim 9, wherein energization of the anode comprises driving the anode in rotation within the enclosure.

16. The method of claim 9, comprising energizing the primary cathode prior to sealing the interior volume.

17. The method of claim 16, wherein the secondary cathode is not energized when the primary cathode is energized prior to sealing the interior volume.

18. An X-ray tube made by the method of claim 9.

19. An X-ray tube comprising:

an electron beam source comprising a primary cathode configured to emit an electron beam;

an anode assembly comprising an anode configured to receive the electron beam and to emit X-rays when impacted by the electron beam;

an enclosure, at least the primary cathode and the anode being disposed in the enclosure; and an ion gauge assembly comprising a secondary cathode, the ion gauge assembly configured to measure pressure within the enclosure during use of the X-ray tube.

20. The X-ray tube of claim 19, comprising a monitoring circuit coupled to the ion gauge assembly and configured to generate a signal representative of vacuum state within the enclosure based upon detection of pressure within the enclosure.

21. The X-ray tube of claim 19, wherein the ion gauge assembly is energizable during manufacture of the X-ray tube to degas an interior volume of the enclosure.

22. The X-ray tube of claim 21, wherein the secondary cathode is disposed adjacent to the anode and emits electrons that impact the anode during degassing.

23. The X-ray tube of claim 19, wherein the secondary cathode comprises a filament configured to be heated to emit electrons, and wherein the ion gauge assembly comprises a grid configured to attract the emitted electrons due to a potential difference between the filament and the grid, and a collector configured to collect positively charged ions created by collisions between the emitted electrons and gas molecules within the enclosure.

* * * * *